US010179473B2

(12) United States Patent
Yaron Kukavka

(10) Patent No.: US 10,179,473 B2
(45) Date of Patent: Jan. 15, 2019

(54) SYSTEM DEVICE AND METHOD FOR FLAGGING DOCUMENTS

(71) Applicant: Yeshaya Shmuel Yaron Kukavka, Givataim (IL)

(72) Inventor: Yeshaya Shmuel Yaron Kukavka, Givataim (IL)

(73) Assignee: Yeshaya Shmuel Yaron Kukavka, Givataim (IL)

( * ) Notice: Subject to any disclaimer, the term of this patent is extended or adjusted under 35 U.S.C. 154(b) by 181 days.

(21) Appl. No.: 14/745,437

(22) Filed: Jun. 21, 2015

(65) Prior Publication Data

US 2016/0368306 A1 Dec. 22, 2016

(51) Int. Cl.
*B42F 21/06* (2006.01)

(52) U.S. Cl.
CPC ..... *B42F 21/06* (2013.01)

(58) Field of Classification Search
CPC ..... B42F 21/06
USPC ..... 116/201, 234–240; 33/483, 484, 494
See application file for complete search history.

(56) References Cited

U.S. PATENT DOCUMENTS 3,564,719 A * 2/1971 Feltenberger ..... B43L 5/00 33/437
D235,866 S * 7/1975 Seitz ..... D19/88
4,153,927 A * 5/1979 Owens ..... B43L 3/00 362/110
4,366,626 A * 1/1983 Livick ..... B43L 13/04 281/42
4,401,323 A * 8/1983 Rex ..... B42F 9/00 24/67.11
4,416,392 A * 11/1983 Smith ..... A47K 10/422 206/39.7
4,610,054 A * 9/1986 Malian ..... B42D 5/006 24/67 R
4,653,666 A * 3/1987 Mertens ..... B42D 5/005 221/45
4,679,328 A * 7/1987 Saad ..... B43L 13/004 33/447
5,016,147 A * 5/1991 Voorhees ..... B64D 43/00 108/43
5,116,012 A * 5/1992 Offenhauer ..... A47B 97/02 211/45
D332,114 S * 12/1992 Offenhauer ..... D19/86
(Continued)

FOREIGN PATENT DOCUMENTS

EP 2347915 A1 * 7/2011 ..... B42D 5/005

OTHER PUBLICATIONS

Derwent Abstract: Schmidt, "Plastics drawing ruler has at one end on top side interchangable dispenser box of notelet papers", Aug. 20, 1998, Abstract.*

*Primary Examiner* — R. A. Smith
*Assistant Examiner* — Tania Courson
(74) *Attorney, Agent, or Firm* — Vladimir Sherman; Professional Patent Solutions Ltd.

(57) ABSTRACT

Disclosed are a system, device and method for flagging documents, wherein a Flagging Device (FD) retains one or more page flags and affixes them to the edges of a document's pages, and a Flagging Ruler (FR) detachably accepts the Flagging Device (FD) while allowing for it to travel and be positioned along its length, while accepting and holding one or more pages, to be flagged, relative to the Flagging Device FD.

8 Claims, 9 Drawing Sheets

(56) References Cited

U.S. PATENT DOCUMENTS 5,337,484 A * 8/1994 Cardon ..... B43L 15/00 33/41.2
5,671,951 A * 9/1997 Palmiter ..... B42D 3/12 206/214
5,732,925 A * 3/1998 Shamoon ..... B42D 9/002 248/450
5,755,356 A * 5/1998 Bastiaens ..... B42D 5/005 221/33
5,823,500 A * 10/1998 La Coste ..... B43L 3/008 248/444
6,024,384 A * 2/2000 Jones ..... B42D 5/042 248/452
6,415,521 B1 * 7/2002 Schnell ..... A01K 97/00 33/485
6,648,173 B2 * 11/2003 Crawford ..... B42D 5/005 206/449
6,681,452 B1 * 1/2004 Holland ..... B42F 1/006 221/33
D495,369 S * 8/2004 Holland ..... D19/88
6,905,104 B1 * 6/2005 Offenhauer ..... B42F 9/001 248/444.1
D537,120 S * 2/2007 Mandel ..... D19/88
7,219,437 B2 * 5/2007 Dallman ..... B42F 9/002 33/18.2
D574,435 S * 8/2008 Jour ..... D19/86
7,484,304 B2 * 2/2009 Campagna ..... G01C 15/004 33/286
8,397,410 B1 * 3/2013 Lau ..... B42F 1/006 116/236
8,459,451 B2 * 6/2013 Lau ..... B42D 5/005 206/223
8,763,263 B2 * 7/2014 Dallman ..... B43L 3/00 33/18.2
2002/0051676 A1 * 5/2002 Urness ..... B42F 13/40 402/73
2004/0083635 A1 * 5/2004 Frappell ..... B42F 21/06 40/641
2006/0091028 A1 * 5/2006 Bastiaens ..... B42D 5/006 206/307.1
2010/0116872 A1 * 5/2010 Kent ..... B42F 7/02 229/67.1
2012/0091015 A1 * 4/2012 Jour ..... B42D 5/005 206/215
2012/0133118 A1 * 5/2012 Jour ..... B42D 5/005 281/42
2012/0201594 A1 * 8/2012 Busam ..... B42F 21/06 402/4

* cited by examiner

FD Spring Pin
Perspective View

FD Spring Pin Cross
Section View

FD Spring Pin
Side View

FD Spring Side View

FD Spring Top View

Flagging Ruler (FR) Top View

SYSTEM DEVICE AND METHOD FOR FLAGGING DOCUMENTS

FIELD OF THE INVENTION

The present invention generally relates to the field of stationery. More specifically, the present invention relates to a system, device and method for flagging documents.

BACKGROUND

In the field of stationery and stationery products, various products provide solutions for labeling, flagging, tabbing and/or elsewise marking specific pages or sections of multi-page documents. Such solutions include: cardboard or thick paper dividers, plastic dividers and/or page markers that may each be connected to a divider, or to an actual document page, that is positioned at the beginning of a section of the document or has other significance.

Still, there remains a need, in the field of stationery and stationery products, for solutions that may facilitate the utilization of page flags/tabs (hereinafter "flags") by allowing users to more efficiently and accurately position and affix page flags onto document pages or dividers.

SUMMARY OF THE INVENTION

Disclosed, are a system, device and method for flagging documents. A user may utilize a system in accordance with embodiments of the present invention, to position, align and affix one or more page flags at specific positions, and possibly at specific distances, along a document's pages edges.

According to some embodiments of the present invention, a system for flagging documents may include: (1) a Flagging Device (FD) for retaining one or more page flags and affixing the page flag(s) to the edge of a document page; and (2) a Flagging Ruler (FR) for detachably accepting the Flagging Device (FD) while allowing for it to travel along its length, and for accepting one or more pages to be flagged by the Flagging Device (FD) with prefixed distances.

According to some embodiments of the present invention, The Flagging Device (FD) may comprise: (1) a Bottom Section for connecting to the Flagging Ruler (FR); (2) a Top Section for facilitating the positioning and affixing of the one or more page flag(s) to the edge of a document page; (3) an FD Spring Pin acting as a connecting axle between the Top Section and the Bottom Section; and (4) an FD Spring for clamping the Top Section and the Bottom Section over the Flagging Ruler (FR).

According to some embodiments of the present invention, The Flagging Ruler (FR) may be of a substantially elongated shape and may comprise: (1) a First Long Edge for detachably accepting the Bottom Section of the Flagging Device (FD); and (2) a substantially parallel Second Long Edge for accepting one or more pages to be flagged and retaining them at a preset position relative to the Flagging Device (FD).

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings:

Figure 1:
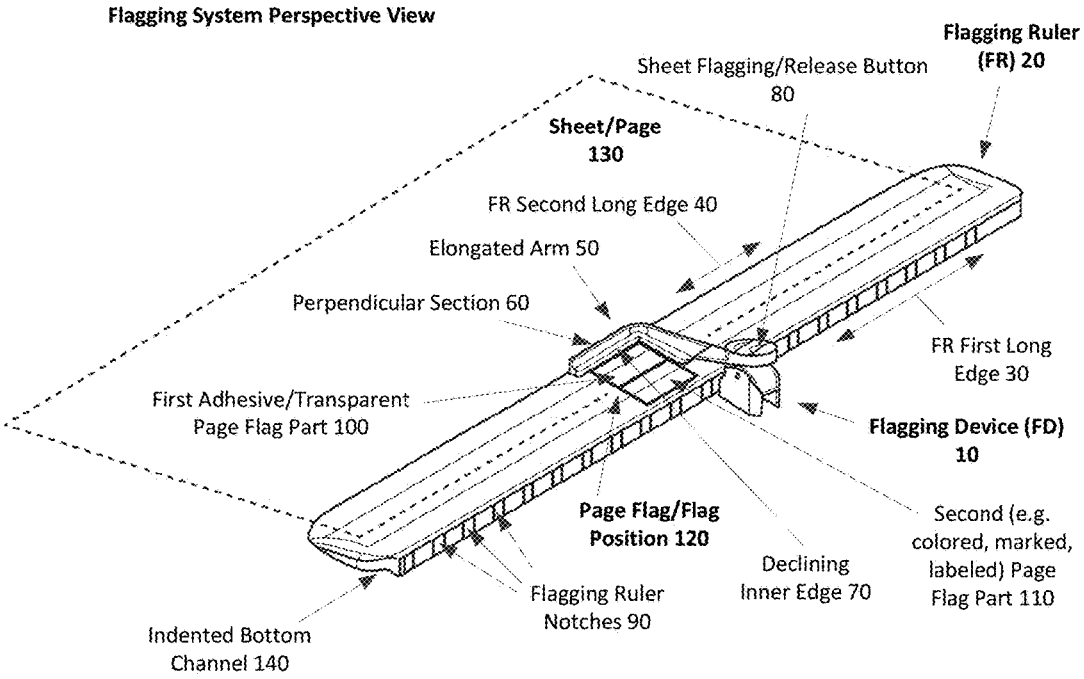
FIG. 1 shows a projection of an exemplary system for document flagging, including a page being flagged and a page flag affixed to the page, in accordance with some embodiments of the present invention.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Unless specifically stated otherwise, as apparent from the following discussions, it is appreciated that throughout the specification discussions utilizing terms such as "accepting", "retaining", "positioning", "clamping", or the like, may refer to any action and/or processes wherein two or more invention system or device components, and/or invention related or interfaced objects, are statically or dynamically connected to, and/or in relation to, each other.

Functions, operations, components and/or features described herein with reference to one or more embodiments, may be combined with, or may be utilized in combination with, one or more other functions, operations, components and/or features described herein with reference to one or more other embodiments, or vice versa.

The present invention is a system, device and method for flagging documents. A user may utilize a system in accordance with embodiments of the present invention, to position, align and affix one or more page flags at specific positions, and possibly at specific distances, along a document's pages edges.

According to some embodiments of the present invention, a system for flagging documents may include: (1) a Flagging Device (FD) for facilitating the positioning and affixing of one or more page flag(s) to the edge of a document page; and (2) a Flagging Ruler (FR) for detachably accepting the Flagging Device (FD) while allowing for it to travel along its length, and for accepting one or more pages to be flagged by the Flagging Device (FD).

According to some embodiments of the present invention, The Flagging Device (FD) may comprise: (1) a Bottom Section for connecting to the Flagging Ruler (FR); (2) a Top Section for facilitating the positioning and affixing of the one or more page flag(s) to the edge of a document page; (3) an FD Spring Pin acting as a connecting axle between the Top Section and the Bottom Section; and (4) an FD Spring for clamping the Top Section and the Bottom Section over the Flagging Ruler (FR).

According to some embodiments of the present invention, The Flagging Ruler (FR) may be of a substantially elongated shape and may comprise: (1) a First Long Edge for detachably accepting the Bottom Section of the Flagging Device (FD); and (2) a substantially parallel Second Long Edge for accepting one or more pages to be flagged and retaining them at a preset position relative to the Flagging Device (FD).

According to some embodiments, the First Long Edge of the FR may comprise two or more notches, dents, holes, grooves or openings, set at substantially similar distances from each other. According to some embodiments, the Bottom Section of the FD may comprise a pin, tooth, bump or gearwheel designed to fit, click or snap into one of the two or more notches, dents, holes, grooves or openings in the First Long Edge of the FR, while retaining the Bottom Section of the FD, and thus the entire FD, to one of two or more preset positions along the First Long Edge of the FR; wherein the two or more preset positions are defined by the positions of the two or more notches, dents, holes, grooves or openings. Accordingly, page flags may be set: (i) at substantially similar distances from each other along the edge of a page being flagged, (ii) at distances/positions complying with one or more dimensions of page flag products (e.g. 3M's page flags) found/popular in the stationary market, (iii) such that the edges of multiple pages may be flagged at corresponding positions (e.g. same positions on each of the multiple pages), and/or (iv) along the edges of multiple pages such that the distance between the flags of each pair of following flagged pages is substantially identical.

According to some embodiments, the Top Section of the FD may comprise an elongated arm for positioning the one or more page flags. According to some embodiments, the elongated arm may comprise a substantially perpendicular section connected to, or around, its tip for positioning/'marking the position of the page flag(s) over the edge of a document page being retained by and/or against the Second Long Edge of the FR. According to some embodiments, the Top Section of the FD, on the opposite side of the elongated arm, may comprise a flagging/release/arm-lifting lever and/or button.

According to some embodiments, pressing the lever/button against the FD Spring may raise the elongated arm allowing a document page to be introduced into the Second Long Edge of the FR. Releasing the lever/button may cause the elongated arm to return to its originally biased position over the introduced page, while retaining it in position and marking a flag position along the edge of the document page corresponding to the position of the FD along the FR.

According to some embodiments, when in its biased position, the elongated arm, along with its perpendicular section, may mark a position for affixing a page flag, wherein the marked position corresponds to a respective position of the FD along the FR. The vertex of the substantially right angle formed between the main section of the elongated arm and its perpendicular section, may mark the positioning point of the corner of the page flag being affixed. According to some embodiments, the distance between the inner edge (closer to the FR) of the perpendicular section and the edge of a retained page being flagged, may substantially match the width of an adhesive (and possibly transparent) part of a specific page flag type or page flag size standard being used. Accordingly, when the page flag is positioned with its corner at the vertex of the substantially right angle between the main section of the elongated arm and its perpendicular section, and then affixed—the adhesive (and possibly transparent) part of the page flag may extend to the edge of the page being flagged, while a second, possibly colored, marked, and/or labeled part of the page flag, remains 'hanging'/'sticking-out' beyond/outside the edge of the flagged page.

According to some embodiments, the perpendicular section, and/or possibly the elongated arm, may comprise a declining inner edge, wherein the thickness of the arm/section decreases towards its inner edge (i.e. inner edge: for the elongated arm—the edge facing in the same direction that the perpendicular section is pointing to; for the perpendicular section—the edge closer to the FR). The declining inner edge may assist the positioning of the page flag, with its corner at the vertex of the substantially right angle between the main section of the elongated arm and its perpendicular section, causing the flag to fall/slide down the declining edge, off the arm/section, and onto the page—at the designated position.

According to some embodiments, the Bottom Section of the FD, and thus the entire FD, may travel substantially freely along the FR, wherein the pin, tooth, bump or gearwheel of the Bottom Section snaps into, and out of, the designated positions' dents, holes, grooves or openings in the First Long Edge of the FR, as the FD is slid along the FR.

According to some embodiments, the Top Section and the Bottom Section of the FD may travel or be slid by a user, to another position along the First Long Edge of the FR and be clicked or snapped into another dent, hole, groove or opening, in the First Long Edge of the FR, corresponding to the new position, while retaining the Bottom Section of the FD, and thus the entire FD at the new position.

According to some embodiments, the FR may have one or more measurement markings and/or one or more sets of segments markings on its top side. According to some embodiments, the measurement markings may allow for the positioning of the FD along the FR at measured distance(s): from the top or bottom tip (or measuring scale) of the FR and thus from the top or bottom of a retained document page being flagged, and/or at a measured distance from previously affixed flags. According to some embodiments, the markings may correspond to common page flag sizes thus enabling the setting of the FD along the FR in accordance with the relevant flag size in use. According to some embodiments, the one or more sets of segments markings may allow for affixing a predetermined number of page flags onto two or more selected pages of a document at substantially similar distances from one another.

According to some embodiments, an exemplary set of segments markings may include two or more aligned rectangular boxes, collectively stretching: along the length of the FR, and in parallel to substantially the entire length of the edge of a document page being retained by the FR. Positioning the FD along the FR at each of a set of positions, and affixing a page flag at each of the positions, wherein each position in the set corresponds to a respective segment marking or part thereof (e.g. segment marking starting point, ending point, center point), will result in a set of flags affixed to the document, wherein the number of flags is similar to the number of segments markings, and the flags are positioned at substantially similar distances from each other.

In FIG. 1 there is shown, in accordance with some embodiments of the present invention, a system for flagging documents including: (1) a Flagging Device (FD) (10) for facilitating the positioning and affixing one or more page flag(s) (120) to the edge of a document page (130); and (2) a Flagging Ruler (FR) (20) for detachably accepting the Flagging Device (FD) while allowing for it to travel along its length, and for accepting one or more pages to be flagged by the Flagging Device (FD).

The Flagging Device (FD) (10) comprises: (1) a Bottom Section for connecting to the Flagging Ruler (FR); (2) a Top Section for facilitating the positioning and affixing of the one or more page flag(s) (120) to the edge of a document page (130); (3) an FD Spring Pin (not shown) acting as a connecting axle between the Top Section and the Bottom Section; and (4) an FD Spring (not shown) for clamping the Top Section and the Bottom Section over the Flagging Ruler (FR) (20).

The Flagging Ruler (FR) (20), having a substantially elongated shape, comprises: (1) a First Long Edge (30) for detachably accepting the Bottom Section of the Flagging Device (FD) (10) into an indented bottom channel (140) running along the edge of the Flagging Ruler (FR) (20), setting a route for the Flagging Device (FD) (10) to travel alongside the Flagging Ruler (FR) (20); and (2) a substantially parallel Second Long Edge (40) for accepting one or more pages (130) to be flagged and retaining them at a preset position relative to the Flagging Device (FD) (10).

The Top Section of the FD (10) comprises an elongated arm (50) for positioning the one or more page flags (120). The elongated arm (50) comprises a substantially perpendicular section (60) connected to, or around, its tip for positioning/'marking the position of' the page flag(s) (120) over the edge of a document page (130) being retained by and/or against the Second Long Edge of the FR (40). The perpendicular section (60), and/or possibly the elongated arm (50), may comprise a declining inner edge (70). The top Section of the FD (10), on the opposite side of the elongated arm, comprises a flagging/release/arm-lifting lever and/or button (80).

The Bottom Section of the FD comprises a pin, tooth, bump or gearwheel (not shown) designed to fit, click or snap into one of the two or more Flagging Ruler notches, dents, holes, grooves or openings (90) in the First Long Edge of the FR (30), while retaining the Bottom Section of the FD, and thus the entire FD, to one of two or more preset positions along the First Long Edge of the FR (30); wherein the two or more preset positions are defined by the positions of the two or more notches, dents, holes, grooves or openings (90).

The distance between the inner edge (closer to the FR (20)) of the perpendicular section (60) and the edge of a retained page (130) being flagged, substantially matches the width of an adhesive (and possibly transparent) part (100) of a specific page flag type or page flag size standard being used. The second, possibly colored, marked, and/or labeled part of the page flag (110), remains 'hanging'/'sticking-out' beyond/outside the edge of the flagged page.

Figure 2:
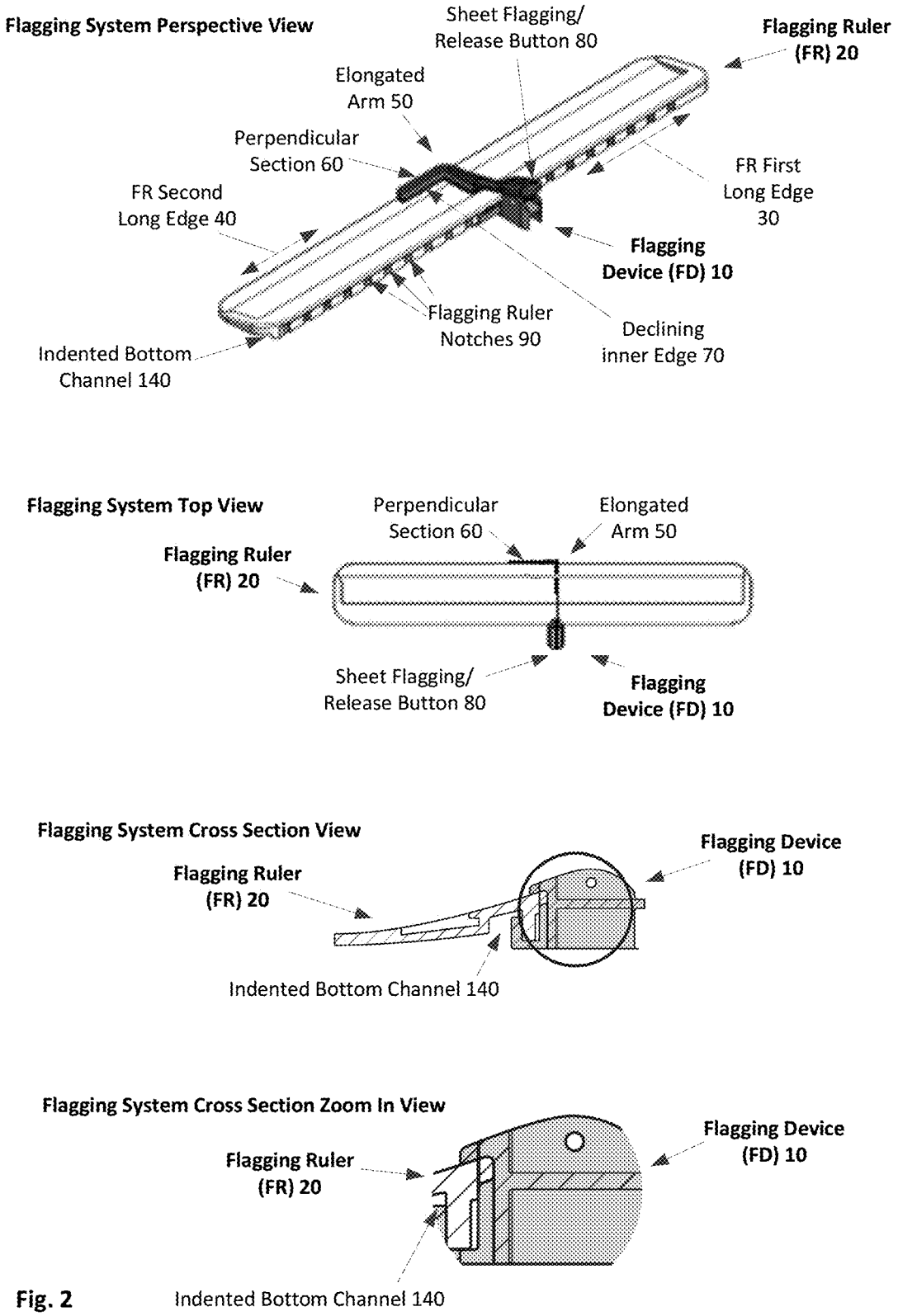
FIG. 2 shows projections, views and cross sections of an exemplary system for document flagging, in accordance with some embodiments of the present invention.

In FIG. 2 there are shown, in accordance with some embodiments of the present invention, perspective, top, cross section and cross section zoom-in views of an exemplary system for document flagging, in accordance with some embodiments of the present invention. Flagging system components shown in the figure include the Flagging Device (FD) (10), along with its: elongated arm (50), perpendicular section (60), declining inner edge (70) and sheet flagging/release button (80); and further include the Flagging Ruler (FR) (20), along with its: first long edge (30), second long edge (40), flagging ruler notches (90) and indented bottom channel (140).

Figure 3A:
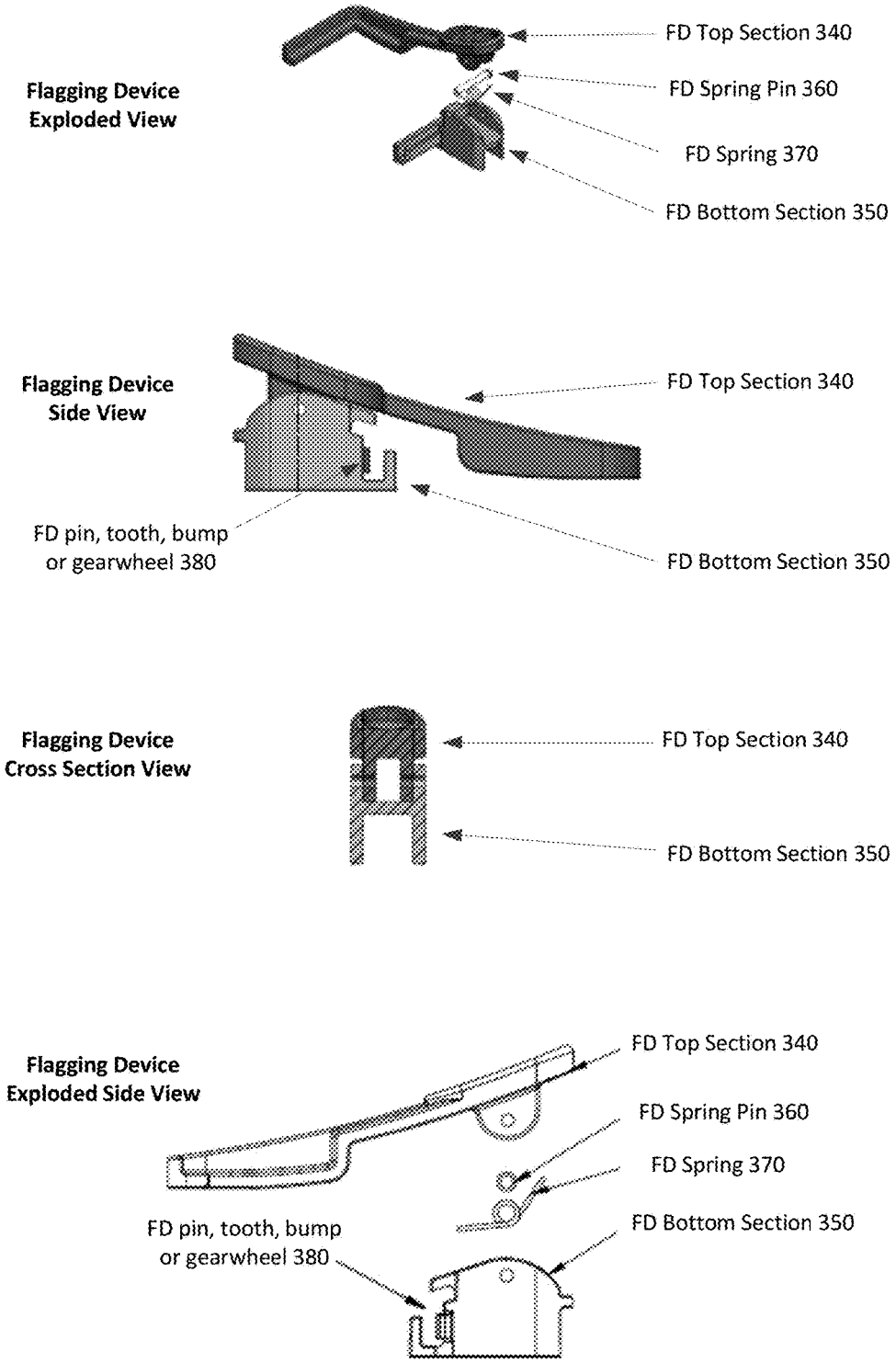
FIG. 3A shows projections, views and cross sections of an exemplary flagging device for document flagging, in accordance with some embodiments of the present invention.

In FIG. 3A there are shown, in accordance with some embodiments of the present invention, exploded, side, cross-section and exploded-side views of an exemplary flagging device (FD) (10) for document flagging. The FD Spring Pin (360) acts as a connecting axle between the Top Section (340) and the Bottom Section (350) while the FD Spring (370) clamps the Top Section and the Bottom Section over the Flagging Ruler (FR) (20) while retaining the flagged page/sheet (130) introduced to the FR (20). Further shown is the FD pin, tooth, bump or gearwheel (380) designed to fit, click or snap into one of the two or more Flagging Ruler notches, dents, holes, grooves or openings (90) in the First Long Edge of the FR (30).

Figure 3B:
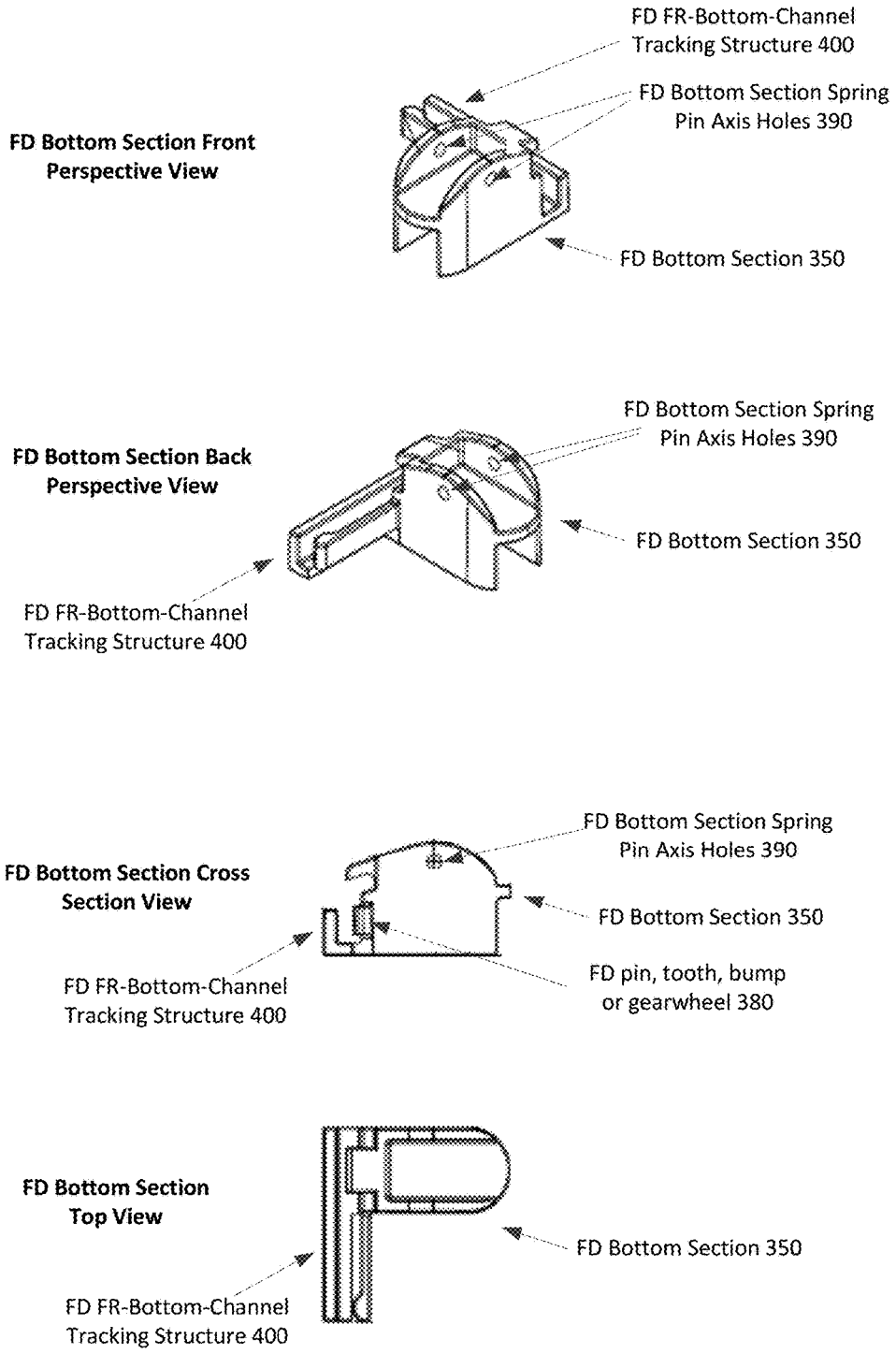
FIG. 3B shows projections, views and cross sections of an exemplary bottom section of a flagging device, in accordance with some embodiments of the present invention.

In FIG. 3B there are shown, in accordance with some embodiments of the present invention, front perspective, back perspective, cross section and top views of an exemplary bottom section (350) of a flagging device (10). FD bottom section (350) components shown in the figure include: the FD pin, tooth, bump or gearwheel (380), FD bottom section spring pin axis holes (390) and an FD FR-bottom-channel tracking structure (400).

Figure 3C:
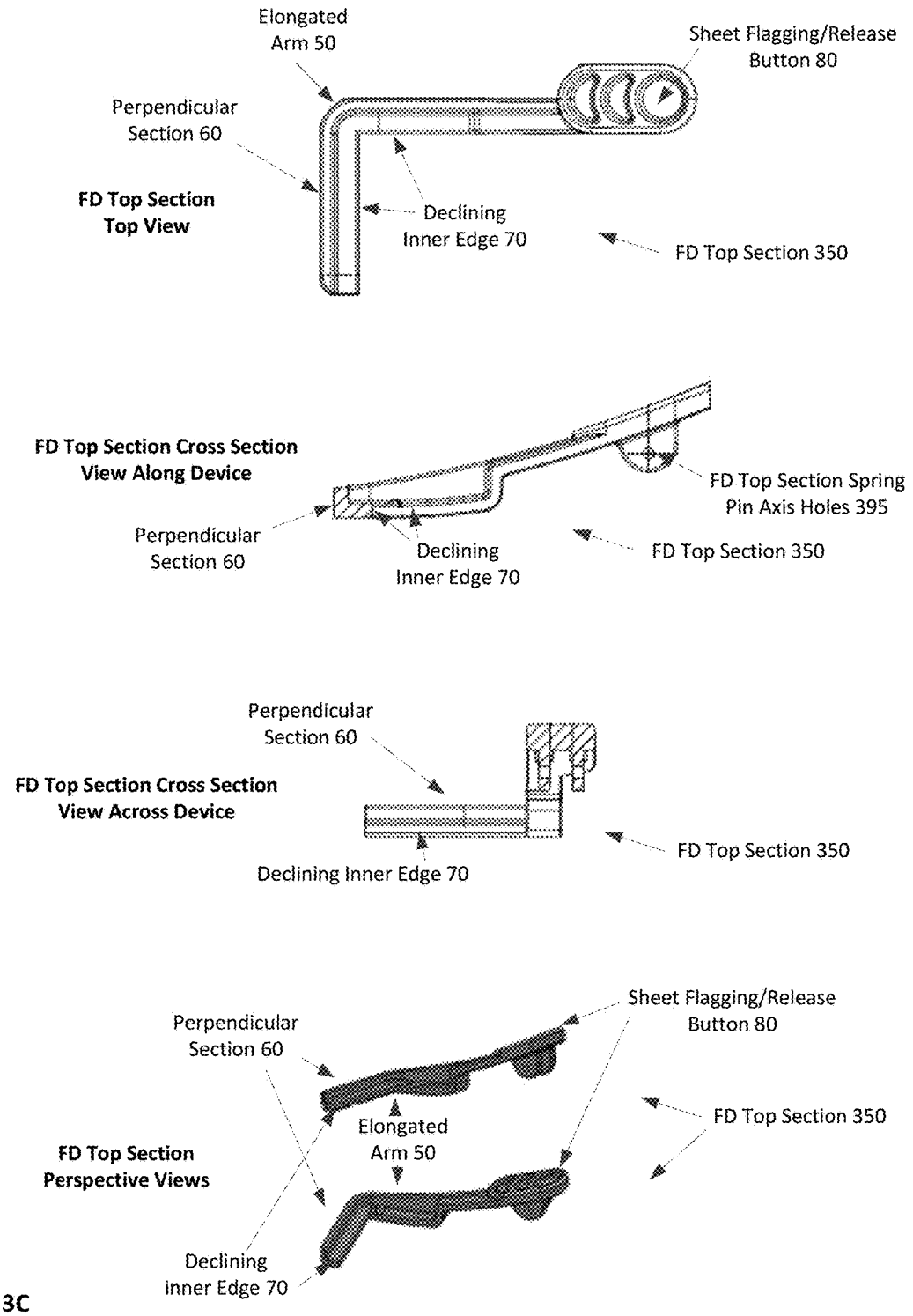
FIG. 3C shows projections, views and cross sections of an exemplary top section of a flagging device, in accordance with some embodiments of the present invention.

In FIG. 3C there are shown, in accordance with some embodiments of the present invention, top, cross section along, cross section across and perspective views of an exemplary top section (340) of a flagging device (10). FD top section (340) components shown in the figure include: the elongated arm (50), the perpendicular section (60), the declining inner edge (70), the sheet flagging/release button (80) and FD top section spring pin axis holes (395).

Figure 3D:
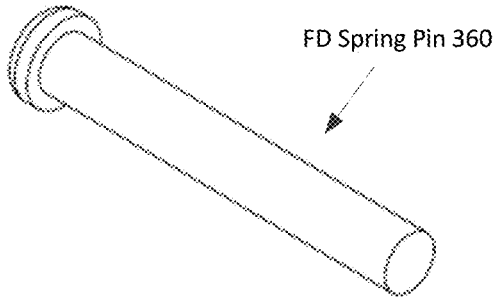
FIG. 3D shows projections, views and cross sections of an exemplary flagging device spring pin of a flagging device, in accordance with some embodiments of the present invention.
Figure 3D:
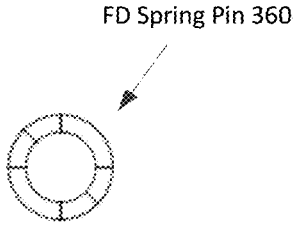
Figure 3D:
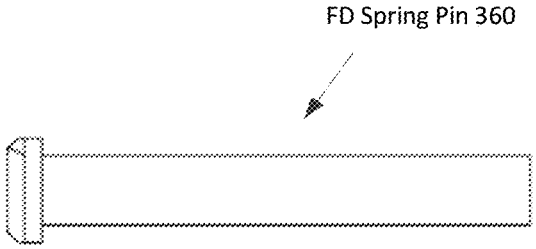

In FIG. 3D there are shown, in accordance with some embodiments of the present invention, perspective, cross section and side views of an exemplary flagging device spring pin (360) of a flagging device (FD) (10).

Figure 3E:
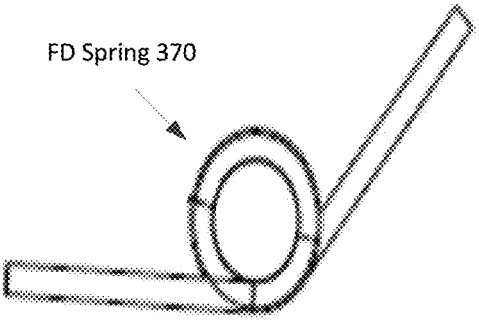
FIG. 3E shows projections, views and cross sections of an exemplary flagging device spring of a flagging device, in accordance with some embodiments of the present invention.
Figure 3E:
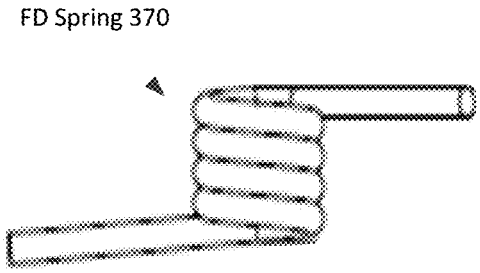

In FIG. 3E there are shown, in accordance with some embodiments of the present invention, side and top views of an exemplary flagging device spring (370) of a flagging device (FD) (10).

Figure 4A:
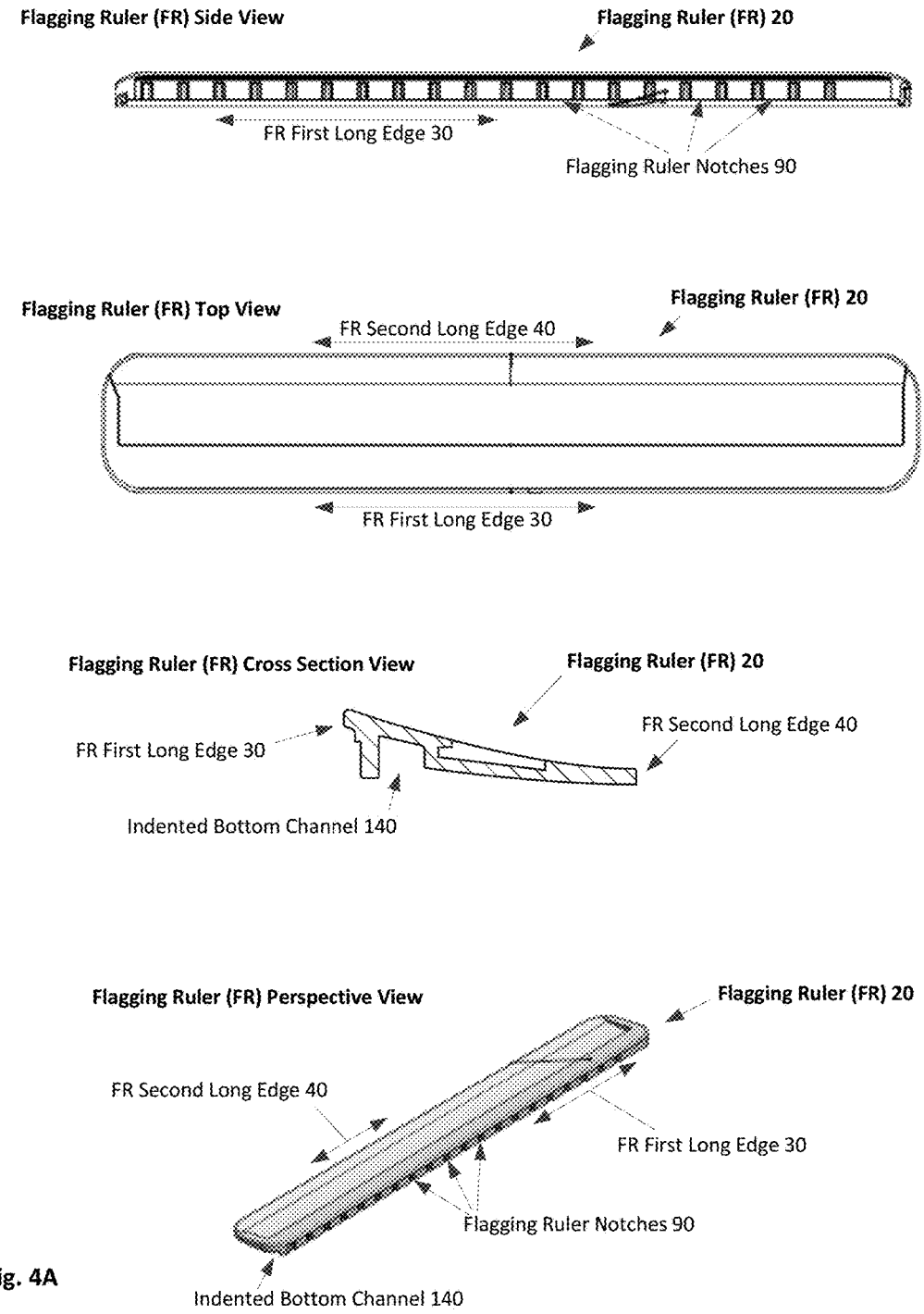
FIG. 4A shows projections, views and cross sections of an exemplary flagging ruler for document flagging, in accordance with some embodiments of the present invention.

In FIG. 4A there are shown, in accordance with some embodiments of the present invention, side, top, cross section and perspective views of an exemplary flagging ruler (FR) (20) for document flagging. Flagging Ruler (FR) (20) components shown in the figure include: the FR first long edge (30), the FR second long edge (40), the FR notches, dents, holes, grooves or openings (90) and the indented bottom channel (140).

Figure 4B:
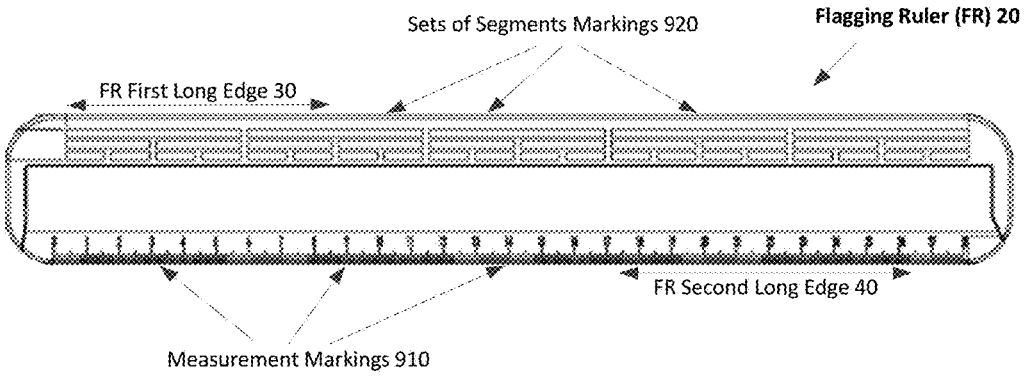
FIG. 4B shows a top view of an exemplary flagging ruler for document flagging, including measurement markings and sets of segments markings, in accordance with some embodiments of the present invention.

In FIG. 4B there is shown, in accordance with some embodiments of the present invention, a top view of an exemplary flagging ruler (FR) (20) for document flagging. Flagging Ruler (FR) (20) components shown in the figure include: the FR first long edge (30), the FR second long edge (40), measurement markings (910) and sets of segments markings (920).

The subject matter described above is provided by way of illustration only and should not be constructed as limiting. While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. A system for flagging documents comprising:

a Flagging Device (FD) for facilitating the positioning and affixing one or more page flag(s) to the edge of a document page; and a Flagging Ruler (FR) comprising: a First Edge for detachably accepting said Flagging Device (FD) into an indented bottom channel running along the edge of said Flagging Ruler (FR), setting a route for said Flagging Device (FD) to travel alongside said Flagging Ruler (FR), and a substantially parallel Second Edge for accepting and retaining in position one or more pages to be flagged alongside their edges, at positions set by said Flagging Device (FD).

2. The system according to claim 1 wherein said Flagging Device (FD) comprises:

a Bottom Section for connecting to the Flagging Ruler (FR);

a Top Section for facilitating the positioning and affixing of the one or more page flag(s) to the edge of said document page;

an FD Spring Pin acting as a connecting axle between said Top Section and said Bottom Section; and an FD Spring for clamping said Top Section and said Bottom Section over said Flagging Ruler (FR).

3. The system according to claim 2 wherein said Flagging Ruler (FR) is of a substantially elongated shape, wherein said First Edge is adapted for detachably accepting the Bottom Section of the Flagging Device (FD); and wherein said substantially parallel Second Edge is adapted for accepting one or more pages to be flagged and retaining them at a preset position relative to the Flagging Device (FD).

4. The system according to claim 1 wherein said Flagging Device (FD) further comprises an elongated arm having a main section emerging from the Flagging Device (FD) and a section perpendicularly connected thereto, wherein the sides of the right angle formed between said main section and said perpendicular section indicates a flag position, along the edge of the one or more retained pages, corresponding to the position of the FD along the FR.

5. The system according to claim 1 wherein said First Edge further comprises three or more notches set at substantially similar distances from each other, adapted to receive a pin, tooth, bump or gear wheel part of said FD, for retaining said FD to one of three or more preset positions along said First Edge of said FR.

6. The system according to claim 2 wherein said Top Section of said FD further comprises an elongated arm and, on the opposite side of said elongated arm, a flagging button, wherein pressing said flagging button against said FD Spring raises said elongated arm allowing for said document page to be introduced into said Second Edge of said FR.

7. The system according to claim 6 wherein releasing said flagging button causes said elongated arm to return to its originally biased position over the introduced page, while retaining it in position and marking a flag position along the edge of the document page corresponding to the position of said FD along said FR.

8. A method for flagging documents comprising:

positioning a Flagging Device (FD) at one of three or more notches preset at substantially similar distances from each other along a first edge of a Flagging Ruler (FR);

introducing one or more pages to be flagged by the Flagging Device (FD) onto a second edge of a Flagging Ruler (FR);

releasing an elongated arm, connected to the Flagging Device (FD), to its biased position over the introduced page(s) such that the elongated arm marks a flag position, along the edge of the introduced page(s), corresponding to the position of the FD along the FR.

* * * * *